US011045823B2

(12) United States Patent
Sesser et al.

(10) Patent No.: US 11,045,823 B2
(45) Date of Patent: Jun. 29, 2021

(54) ROTARY NOZZLE SPRINKLER WITH ORBITAL DIFFUSER

(71) Applicant: NELSON IRRIGATION CORPORATION, Walla Walla, WA (US)

(72) Inventors: George L. Sesser, Walla Walla, WA (US); Craig B. Nelson, Walla Walla, WA (US); Barton R. Nelson, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 123 days.

(21) Appl. No.: 16/323,552

(22) PCT Filed: Nov. 8, 2017

(86) PCT No.: PCT/US2017/060593
§ 371 (c)(1),
(2) Date: Feb. 6, 2019

(87) PCT Pub. No.: WO2018/089462
PCT Pub. Date: May 17, 2018

(65) Prior Publication Data

US 2019/0193095 A1 Jun. 27, 2019

Related U.S. Application Data

(60) Provisional application No. 62/420,216, filed on Nov. 10, 2016.

(51) Int. Cl.
*B05B 3/04* (2006.01)
*B05B 3/00* (2006.01)

(52) U.S. Cl.
CPC ..... *B05B 3/0486* (2013.01); *B05B 3/008* (2013.01); *B05B 3/005* (2013.01)

(58) Field of Classification Search
CPC ..... B05B 3/005; B05B 3/008; B05B 3/02; B05B 3/025; B05B 3/04; B05B 3/0486
(Continued)

(56) References Cited

U.S. PATENT DOCUMENTS 912,493 A * 2/1909 Sanders ..... B05B 3/06 239/261
2,254,270 A 9/1941 Coles et al.
(Continued)

FOREIGN PATENT DOCUMENTS

| | | |
|---|---|---|
| DE | 1 805 846 | 5/1971 |
| EP | 0255463 | 6/1987 |
| EP | 1 389 490 | 2/2004 |

OTHER PUBLICATIONS

International Search Report dated Jan. 22, 2018 issued in PCT International Patent Application No. PCT/US2017/060593, 2 pp.
(Continued)

*Primary Examiner* — Jason J Boeckmann
(74) *Attorney, Agent, or Firm* — Nixon & Vanderhye P.C.

(57) ABSTRACT

A rotary nozzle sprinkler includes a base assembly with a bearing, a stem mounted rotatably in the bearing, and an elbow coupled at a proximal end to and rotatable with the stem and including an elbow bend. A nozzle is secured to a distal end of the elbow, and a diffuser assembly including a brake mechanism is cooperable with the elbow. By positioning the nozzle downstream of the elbow, the sprinkler can achieve a greater throw radius.

13 Claims, 9 Drawing Sheets

(58) Field of Classification Search
USPC ..... 239/251, 252, 261, 263, 264, 222.11, 239/222.13, 222.21
See application file for complete search history.

(56) References Cited

U.S. PATENT DOCUMENTS

| | | | | |
|---|---|---|---|---|
| 2,488,234 | A * | 11/1949 | Perry | B05B 3/0486 239/222.17 |
| 3,743,183 | A | 7/1973 | Malcolm | |
| 4,498,628 | A | 2/1985 | Tucker | |
| 4,886,211 | A | 12/1989 | Cohen | |
| 5,377,914 | A * | 1/1995 | Christen | B05B 3/005 239/252 |
| 5,544,814 | A | 8/1996 | Spenser | |
| 5,971,297 | A | 10/1999 | Sesser | |
| 7,070,122 | B2 | 7/2006 | Burcham et al. | |
| 7,395,977 | B2 | 7/2008 | Pinch et al. | |
| 8,991,724 | B2 | 3/2015 | Sesser et al. | |
| 2006/0006253 | A1 | 1/2006 | Nelson | |
| 2006/0108445 | A1* | 5/2006 | Pinch | B05B 3/0486 239/222.21 |
| 2013/0327846 | A1 | 12/2013 | Sesser | |
| 2014/0224900 | A1 | 8/2014 | Kim et al. | |
| 2014/0263734 | A1 | 9/2014 | Kim | |
| 2015/0224520 | A1 | 8/2015 | Kim et al. | |

OTHER PUBLICATIONS

Extended European Search Report dated Jun. 9, 2020 issued in European Patent Application No. 17868897.4, 8 pp.

* cited by examiner

ROTARY NOZZLE SPRINKLER WITH ORBITAL DIFFUSER

CROSS-REFERENCES TO RELATED APPLICATIONS

This application is the U.S. national phase of International Application No. PCT/US2017/060593 filed Nov. 8, 2017 which designated the U.S. and claims priority to U.S. Provisional Patent Application No. 62/420,216 filed Nov. 10, 2016, the entire contents of each of which are hereby incorporated by reference.

STATEMENT REGARDING FEDERALLY SPONSORED RESEARCH OR DEVELOPMENT (Not Applicable)

BACKGROUND

The invention relates to a rotary nozzle sprinkler and, more particularly, to a rotary nozzle sprinkler with an extended throw radius and a low-cost construction that provides low friction axial load support, braking action, intermittent stream diffusion and clocking of struts.

In some existing designs, a water stream flows through a nozzle and emits to atmosphere axially, and in a high velocity state, the water stream is deflected by a downstream deflector (60° or more) to arrive at a desired trajectory. A downstream deflector utilizes a portion of the energy in the water stream, and as such, the throw radius of the water stream can be limited. An example of a prior art sprinkler of this type is described in U.S. Pat. No. 7,395,977.

BRIEF SUMMARY

It would be desirable to design a rotary nozzle sprinkler with an increased throw radius that overcomes the drawbacks with existing designs.

In some embodiments, the rotary nozzle sprinkler of the described embodiments turns the water upstream of the nozzle when the water is in a much lower velocity state (as compared to the prior art devices). As such, there is less energy lost in the turn, and more energy is in the stream when it shoots radially away from the sprinkler. As a consequence, the sprinkler of the described embodiments will have a greater throw radius than what is possible with existing designs. The design also facilitates the ability to achieve good stream integrity, which also helps the throw radius.

In an exemplary embodiment, a rotary nozzle sprinkler includes a base assembly with a bearing, a stem mounted rotatably in the bearing, an elbow coupled at a proximal end to and rotatable with the stem and including an elbow bend, a nozzle secured to a distal end of the elbow, and a diffuser assembly including a brake mechanism cooperable with the elbow. The elbow bend may be a transverse offset bend. The rotary nozzle sprinkler may further include a cage assembly extending between the diffuser assembly and the base assembly, where the cage assembly is configured to clock around the base assembly with rotation of the elbow. In this context, the cage assembly may include diffuser struts coupled with the diffuser assembly and cage struts coupled with the diffuser struts.

The elbow and stem rotate around an elbow axis of rotation, and the rotary nozzle sprinkler may further include a brake shaft connected between the elbow and the brake mechanism. The brake shaft may have a brake shaft rotation axis that is offset and/or tipped relative to the elbow axis of rotation. The cage assembly may be aligned with the brake shaft rotation axis and may be correspondingly tipped relative to the elbow axis of rotation such that rotation of the elbow effects orbital rotation of the brake shaft rotation axis and the cage assembly. The base assembly may be provided with base lugs, where the cage assembly includes cage teeth, and the base lugs may engage the cage teeth as the cage assembly clocks orbitally around the base assembly. In some embodiments, the rotary nozzle sprinkler is provided with one more of the cage teeth than the base lugs.

The diffuser assembly may include diffuser bumps positioned in a nozzle stream path of the nozzle, where the diffuser bumps clock around the base assembly with the cage assembly.

A brake shaft channel may be secured to the elbow, and the brake shaft may be secured at one end in the brake shaft channel. In this context, the brake mechanism may include a viscous brake, and the brake shaft may be secured at an opposite end to the viscous brake.

The base assembly may include a base securable to a source of water under pressure and having a bore in which the bearing may be disposed, where the rotary nozzle sprinkler may further include a seal disposed between the base and the bearing. A spring may be disposed between the base and the seal that urges the seal into engagement with the bearing.

In another exemplary embodiment, a rotary nozzle sprinkler includes a base assembly including a base having a bore therein and a bearing secured in the bore. An elbow assembly coupled with the base assembly includes an elbow connected for rotation relative to the bearing around an elbow axis of rotation. The elbow is provided with an elbow bend. A nozzle is secured to a distal end of the elbow, and a diffuser assembly including a brake mechanism is cooperable with the elbow.

BRIEF DESCRIPTION OF THE DRAWINGS

These and other aspects and advantages will be described in detail with reference to the accompanying drawings, in which.

DETAILED DESCRIPTION

Figure 1:
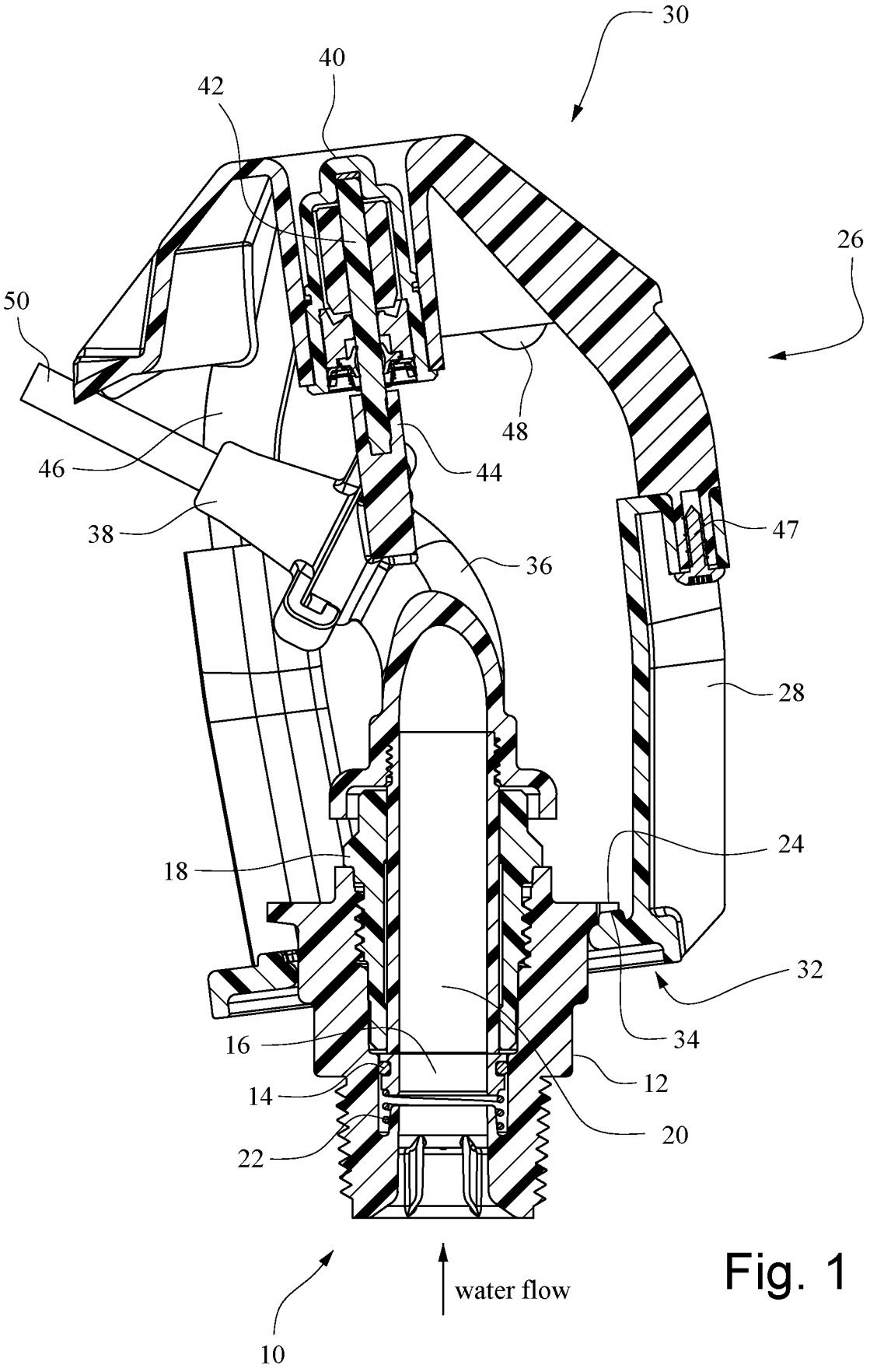
FIG. 1 is a sectional view of the rotary nozzle sprinkler according to preferred embodiments.
Figure 2:
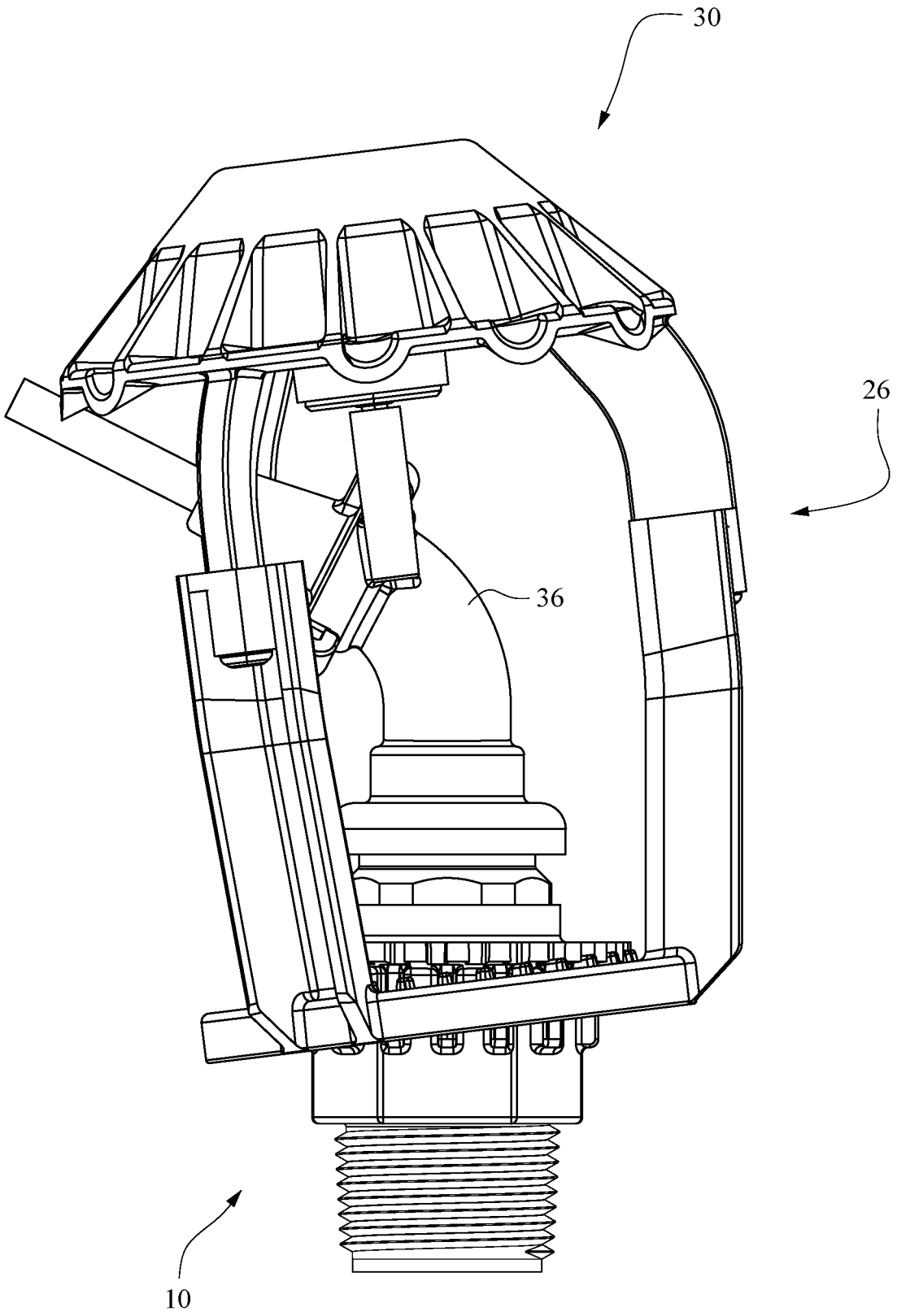
FIG. 2 is an elevation view of the rotary nozzle sprinkler shown in FIG. 1.
Figure 7:
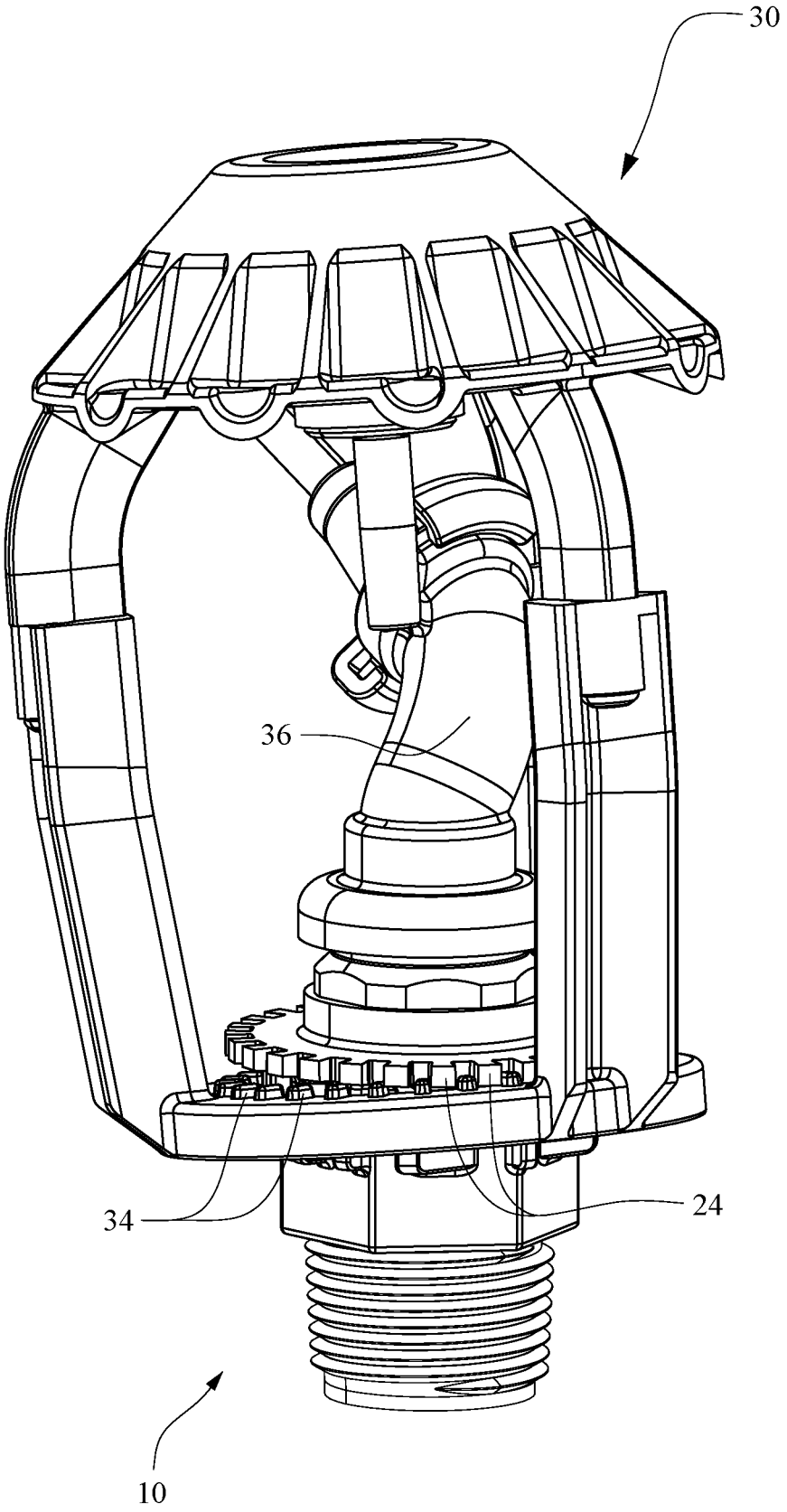
FIGS. 7 and 8 are an elevation view and a sectional view, respectively, of the sprinkler from an opposite side of FIG. 1.
Figure 8:
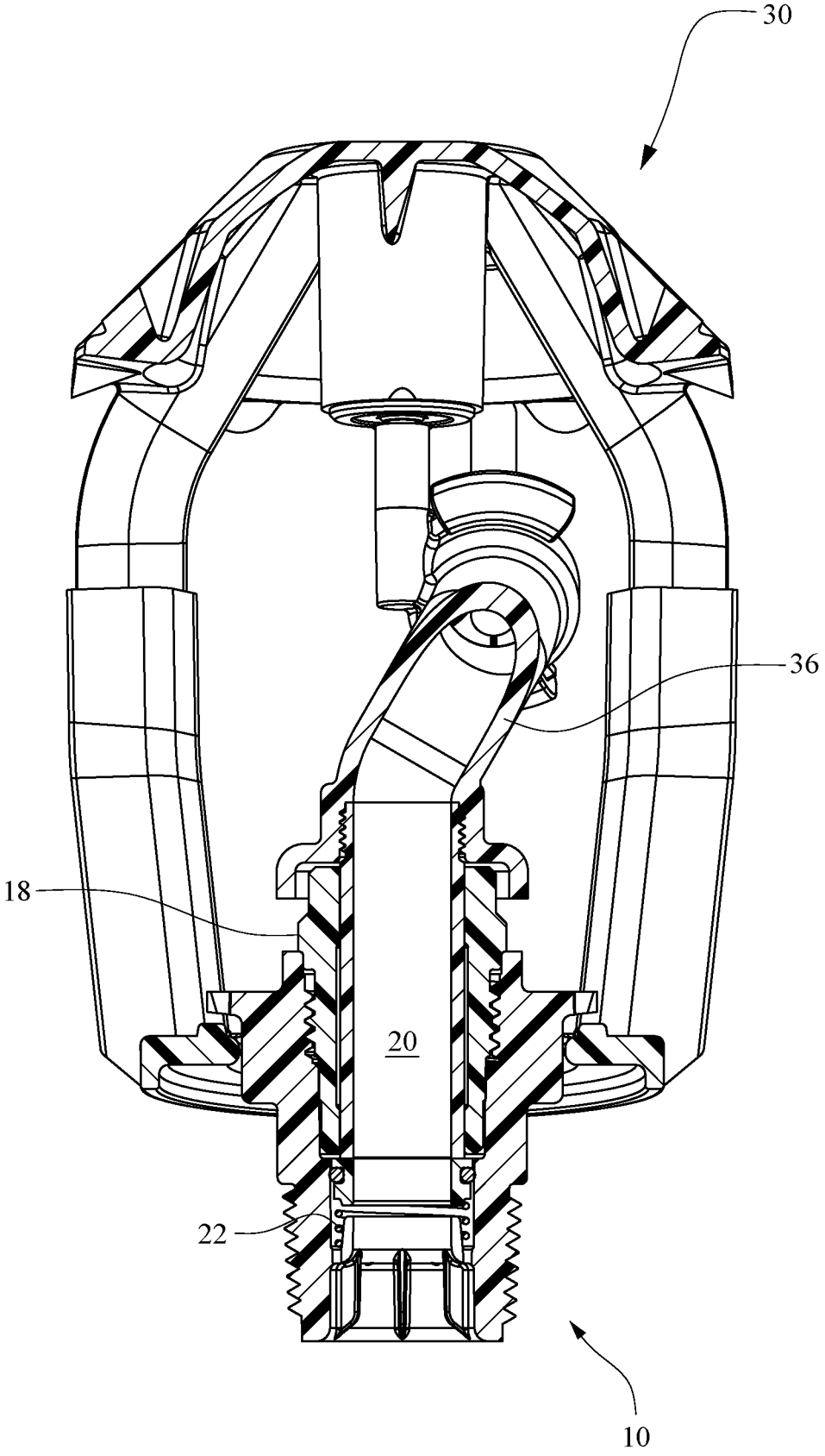
Figure 9:
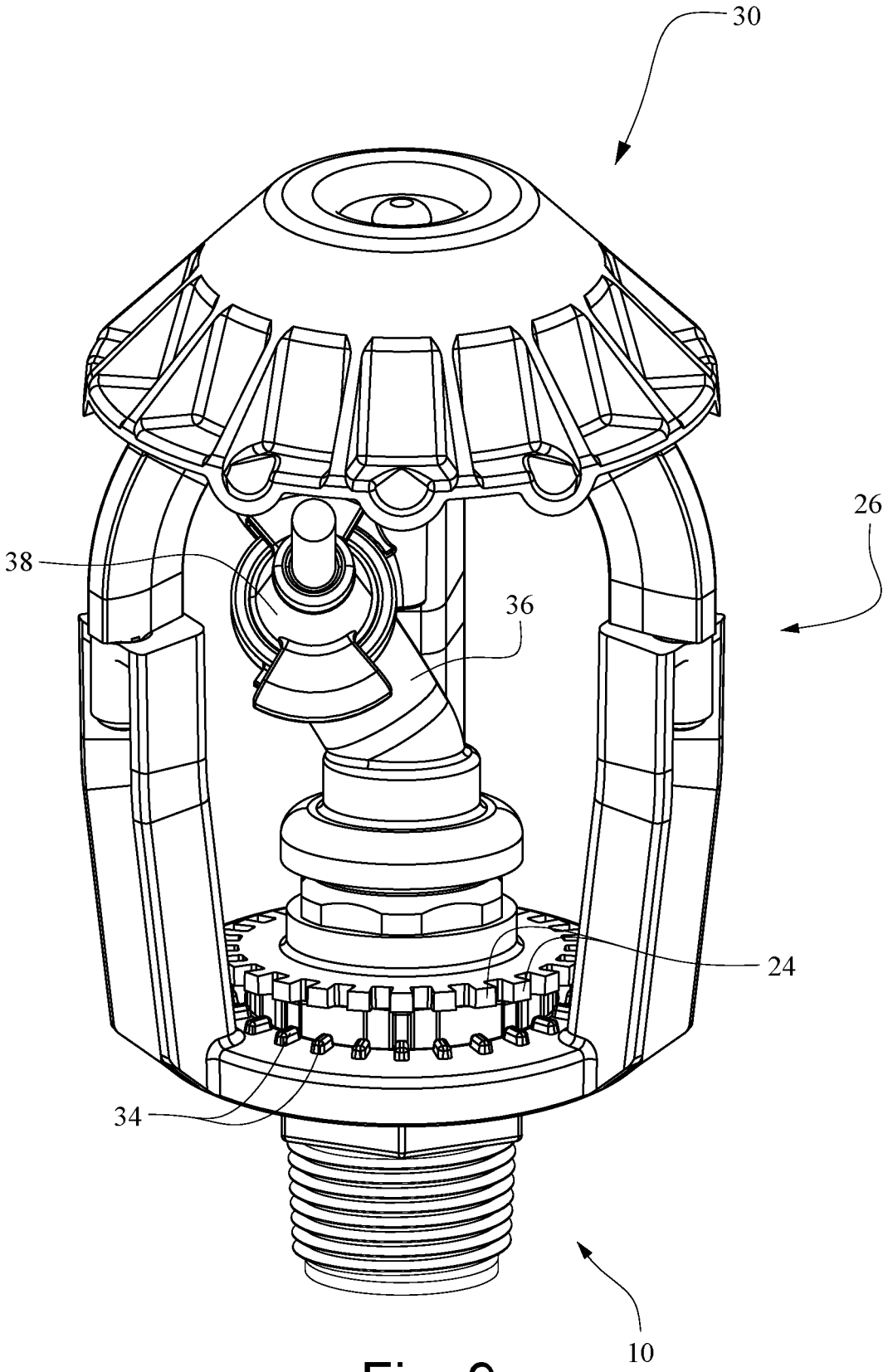
FIG. 9 is an elevation view of the sprinkler from another perspective.

FIG. 1 is a sectional view of the rotary nozzle sprinkler according to preferred embodiments. FIG. 2 is an elevation view of the sprinkler from the same angle. A base assembly 10 includes a base 12 with a threaded end as shown that may be connected to a supply line that in turn is connected to a source of water under pressure. A seal assembly coupled with the base 12 includes a seal 14 having an O-ring 16. A bearing 18 is threaded into a bore in the base 12, and a stem 20 is rotatably supported in the bearing 18. The bearing 18, stem 20 and seal 14 are mounted over a spring 22 that urges the seal 14 into engagement with the inlet face (or lower face) of the stem 20. FIGS. 7-9 show views of the sprinkler from different perspectives.

Figure 3:
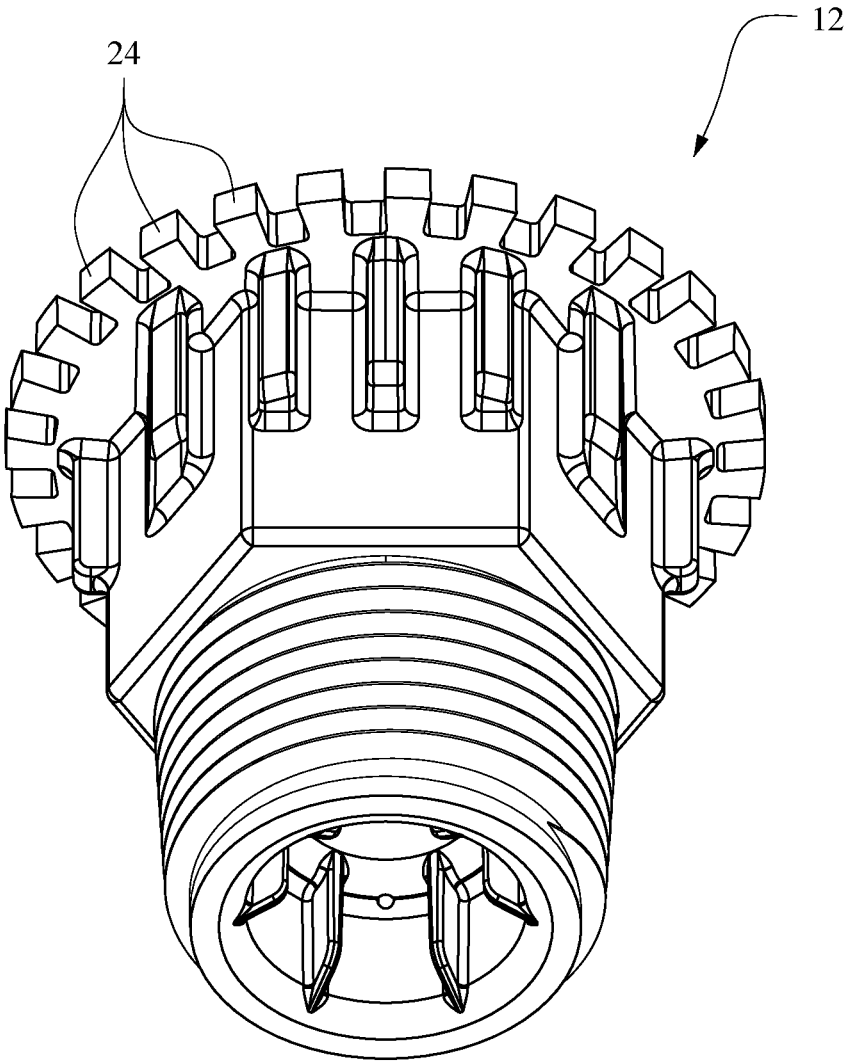
FIG. 3 illustrates a base of the base assembly.

The base 12 includes a plurality of base lugs 24. See FIGS. 3, 7 and 9. The base assembly 10 is cooperable with a cage assembly 26 including cage struts 28 connected between an upper portion/diffuser 30 and a lower portion 32 of the cage assembly 26. The lower portion 32 of the cage assembly 26 includes cage teeth 34 that engage the base lugs 24 of the base assembly 10.

Figure 4:
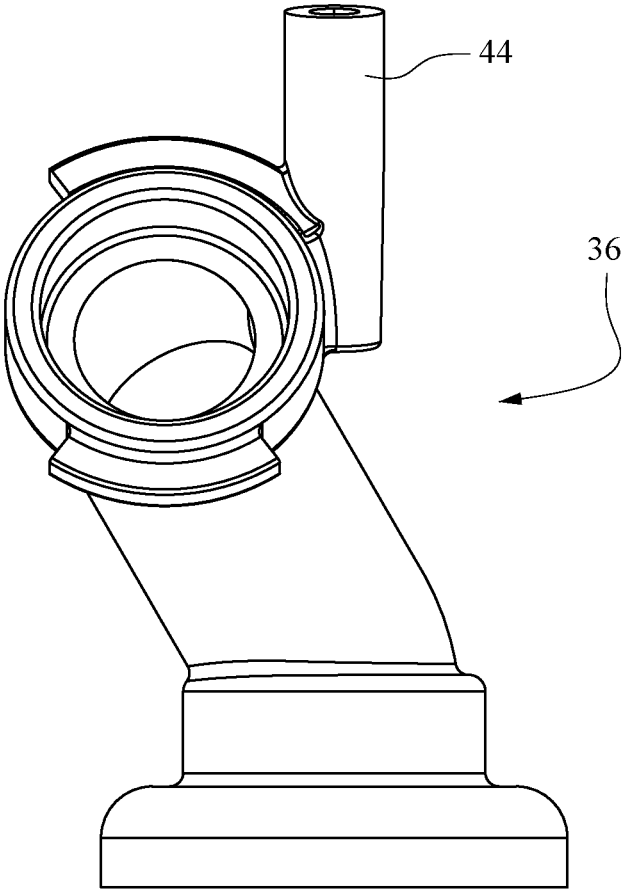
FIG. 4 illustrates an elbow.
Figure 5:
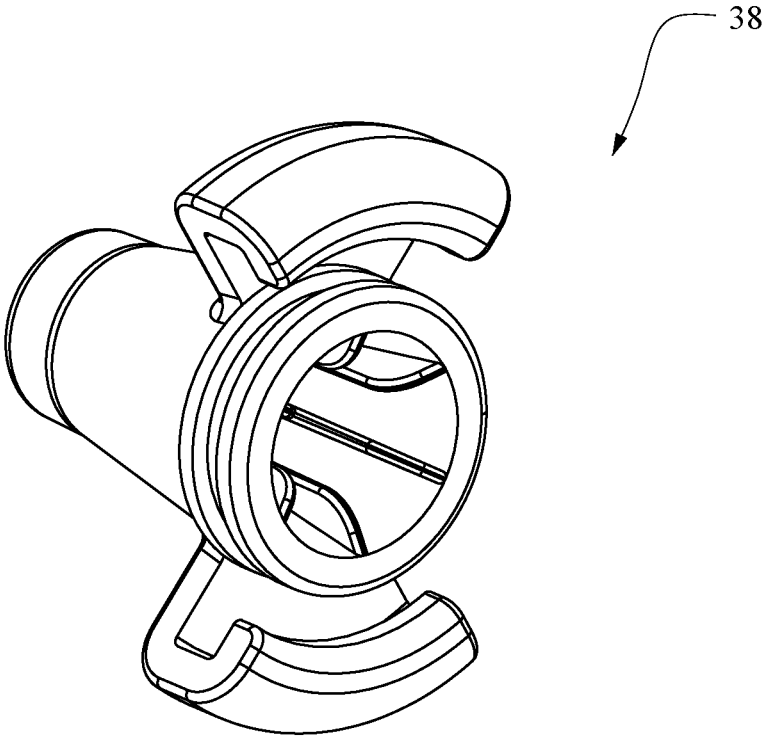
FIG. 5 illustrates a nozzle.

As shown, an elbow 36 is secured by threads or the like over the stem 20, and a nozzle 38 is secured to a downstream end of the elbow 36. A close-up view of an exemplary elbow 36 is shown in FIG. 4, and a close-up view of an exemplary nozzle 38 is shown in FIG. 5. The elbow 36 includes an elbow bend, such as a transverse offset bend, so that a reactionary force from an emitting stream 50 creates rotational drive about a rotational axis of the elbow, which corresponds to a vertical axis of the base 12. The term "transverse offset bend" refers to an elbow that is bent in at least two planes, being a bend forward or backward relative to a water flow direction (see FIG. 1) and a lateral bend or bend to the side. The base 12 and the elbow 36 may be provided with flow straightening vanes so the emitting stream 50 can have maximum stream integrity and radius of throw. The stem 20 may be provided with bearing surfaces to resist the side thrust of the nozzle stream. The elbow 36 and stem 20 may constitute a nozzle assembly. The nozzle 38, elbow 36 and stem 20 all rotate together.

Figure 6:
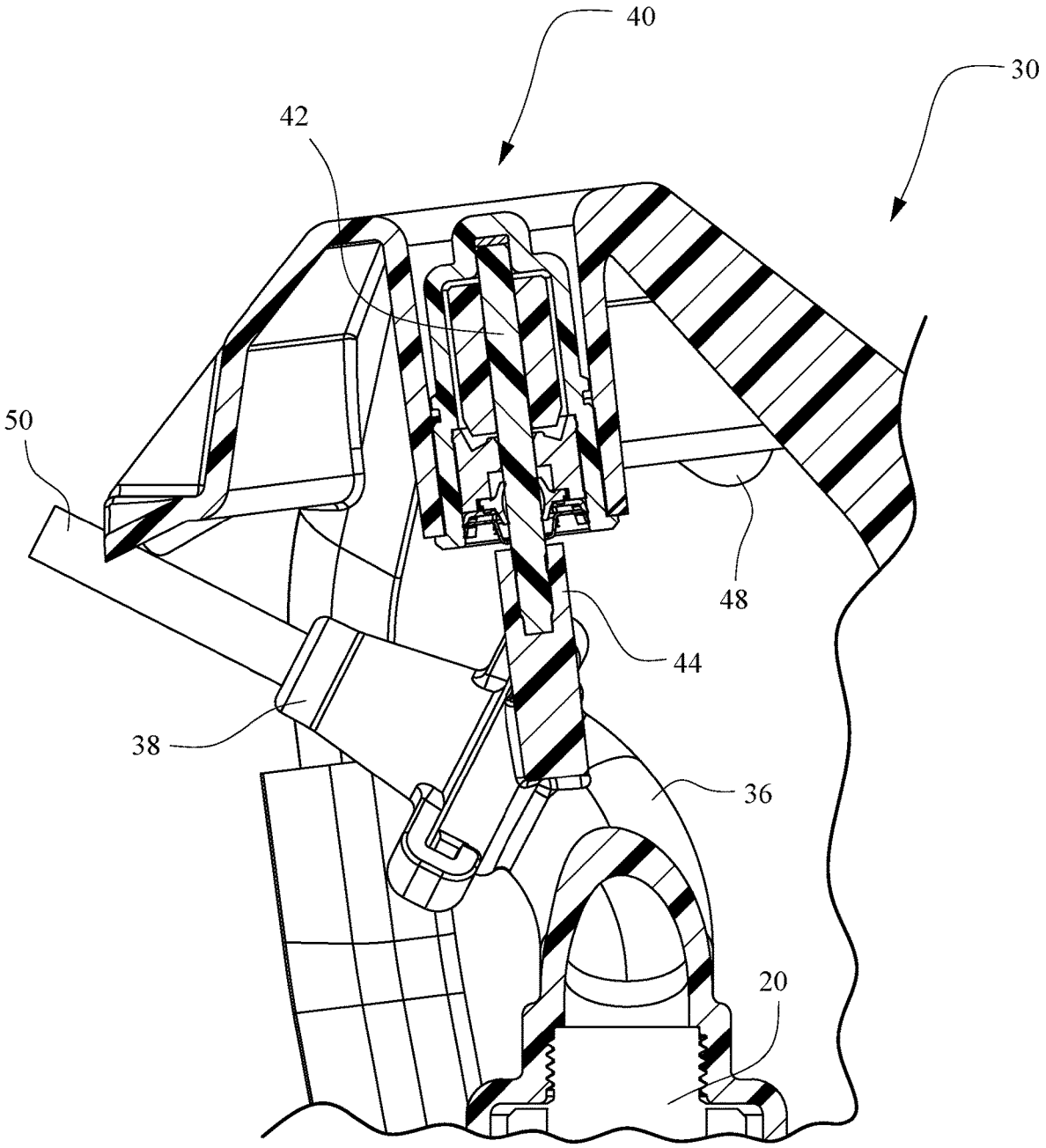
FIG. 6 is a close-up sectional view of the diffuser and brake assembly.

The diffuser 30 includes a brake assembly 40 such as a viscous brake or the like. FIG. 6 is a close-up sectional view of the diffuser 30 and brake assembly 40. A brake shaft 42 is connected at one end to the elbow 36 via a suitable bore or channel 44. Specifically, the brake shaft 42 may be provided with raised knurling on the outside diameter that press fits into the bore/channel 44. The brake shaft 42 is connected at an opposite end to the brake assembly 40. In an exemplary embodiment, an impeller or the like is secured to the opposite end of the brake shaft 42 and is immersed in a viscous fluid. The brake assembly 40 serves to slow rotation of the elbow 36 to counteract the reactionary force on the elbow 36 by the emitting stream 50. Without the brake assembly 40, the nozzle 38, elbow 36 and stem 20 would rotate at a high whirling speed. In some embodiments, the brake assembly 40 slows the rotation to somewhere in the range of 0.25-20 RPM, depending on the application.

The diffuser 30 includes diffuser struts 46 connected with the cage struts 28 via suitable connectors 47 and a plurality of diffuser bumps 48 spaced around an outer periphery of the diffuser 30. As the nozzle 38, elbow 36 and stem 20 rotate by action of the reactionary force on the elbow 36 by the emitting stream 50, the emitting stream 50 intermittently impacts the diffuser bumps 48, which serve to diffuse the stream emitted from the nozzle 38 to provide better coverage of the area being irrigated.

As shown in FIGS. 1, 2, 6 and 7, the diffuser 30 and cage assembly 26 are tipped at an angle such that several of the cage teeth 34 on one side of lower portion 32 are engaged with corresponding ones of the base lugs 24. The axis of the brake shaft 42 is offset and/or tipped relative to the elbow axis of rotation. Rotation of the elbow 36 thus causes the brake axis to rotate in an orbital manner, which drives the diffuser 30 and cage assembly 26 in an orbital manner. In some embodiments, the sprinkler is provided with one more cage tooth 34 than the number of base lugs 24 that mesh with the cage teeth 34 on the one side. As a consequence, the diffuser struts 46 and diffuser bumps 48 clock slowly around. Clocking of the struts is helpful to prevent dry spokes in the water pattern. Clocking of the diffuser bumps is helpful to apply diffusion to all sectors of the water pattern. In an exemplary embodiment, the cage has twenty-eight teeth, and the base has twenty-seven lugs. The contact between mating faces of the base 12 and cage assembly 26 may be a rolling type contact so the upward thrust of the water pressure is resisted in a very low friction, low wear manner.

The design may also be adapted for use on a drop tube, for example, associated with a center pivot irrigation system.

In use, as water under pressure flows through the base 12 into the elbow 36, the water impacts the elbow bend, and a reactionary force from the stream 50 creates rotational drive about the rotational axis of the elbow 36. As the elbow 36 rotates about the elbow rotational axis, the tipped diffuser 30, cage assembly 26 and brake shaft 42 rotate in an orbital manner, and the cage assembly 26 clocks around the base 12. Clocking of the cage assembly 26 prevents spoking of the water pattern that could result from impacting static struts 28, 46 and also serves to displace the diffuser bumps 48. Since the nozzle 38 is downstream of the elbow 36, the stream is turned when the water is in a much lower velocity state. As such, there is less energy lost in the turn, and more energy is in the stream when it shoots radially away from the sprinkler. As a consequence, the sprinkler of the described embodiments can achieve a greater throw radius than what is possible with existing designs.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A rotary nozzle sprinkler comprising:

a base assembly including a bearing;

a stem mounted rotatably in the bearing;

an elbow coupled at a proximal end to and rotatable with the stem and including an elbow bend, wherein the elbow and stem rotate around an elbow axis of rotation;

a nozzle secured to a distal end of the elbow;

a diffuser assembly including a brake mechanism cooperable with the elbow; and a cage assembly including struts extending between the diffuser assembly and the base assembly, the cage assembly being coupled with the elbow via a brake shaft connected between the elbow and the brake mechanism, wherein an axis of the brake shaft is offset and/or tipped relative to the elbow axis of rotation such that the cage assembly is configured to clock around the base assembly by rotation of the elbow, and wherein the diffuser assembly comprises diffuser bumps positioned in a nozzle stream path of the nozzle and spaced around an outer periphery of the diffuser assembly interposed between the struts of the cage assembly, the diffuser bumps clocking around the base assembly with the cage assembly.

2. A rotary nozzle sprinkler according to claim 1, wherein the elbow bend is a transverse offset bend.

3. A rotary nozzle sprinkler according to claim 1, wherein the struts of the cage assembly comprise diffuser struts coupled with the diffuser assembly and cage struts coupled with the diffuser struts.

4. A rotary nozzle sprinkler according to claim 1, wherein the cage assembly is aligned with the brake shaft rotation axis and is correspondingly tipped relative to the elbow axis of rotation such that rotation of the elbow effects orbital rotation of the brake shaft rotation axis and the cage assembly.

5. A rotary nozzle sprinkler according to claim 4, wherein the base assembly comprises base lugs, and wherein the cage assembly comprises cage teeth, the base lugs engaging the cage teeth as the cage assembly clocks orbitally around the base assembly.

6. A rotary nozzle sprinkler according to claim 5, comprising one more of the cage teeth than the base lugs.

7. A rotary nozzle sprinkler according to claim 1, further comprising a brake shaft channel secured to the elbow, wherein the brake shaft is secured at one end in the brake shaft channel.

8. A rotary nozzle sprinkler according to claim 7, wherein the brake mechanism comprises a viscous brake, and wherein the brake shaft is secured at an opposite end to the viscous brake.

9. A rotary nozzle sprinkler according to claim 1, wherein the base assembly comprises a base securable to a source of water under pressure and including a bore in which the bearing is disposed, the rotary nozzle sprinkler further comprising a seal disposed between the base and the bearing.

10. A rotary nozzle sprinkler according to claim 9, further comprising a spring disposed between the base and the seal, the spring urging the seal into engagement with the bearing.

11. A rotary nozzle sprinkler comprising:

a base assembly including a base having a bore therein and a bearing secured in the bore;

an elbow assembly coupled with the base assembly and including an elbow connected for rotation relative to the bearing around an elbow axis of rotation, the elbow including an elbow bend;

a nozzle secured to a distal end of the elbow;

a diffuser assembly including a brake mechanism cooperable with the elbow; and a cage assembly including struts extending between the diffuser assembly and the base assembly, the cage assembly being coupled with the elbow via a brake shaft connected between the elbow and the brake mechanism, wherein an axis of the brake shaft is offset and/or tipped relative to the elbow axis of rotation such that the cage assembly is configured to clock around the base assembly by rotation of the elbow, the diffuser assembly comprising diffuser bumps spaced circumferentially on an underside thereof and around an outer periphery thereof and intermittently in a nozzle stream path of the nozzle, the diffuser bumps being separate from and interposed between the struts of the cage assembly and clocking around the base assembly with the cage assembly.

12. A rotary nozzle sprinkler according to claim 11, wherein the elbow bend is a transverse offset bend.

13. A rotary nozzle sprinkler according to claim 11, wherein the elbow assembly comprises the elbow and a stem mounted rotatably in the bearing, wherein the elbow is secured to the stem.

* * * * *